US005220238A

United States Patent [19]

Lee

[11] Patent Number: 5,220,238

[45] Date of Patent: Jun. 15, 1993

[54] CATHODE STRUCTURE FOR AN ELECTRON TUBE AND METHOD OF CONSTRUCTING IT

[75] Inventor: Kyung Sang Lee, Kyungsangbuk, Rep. of Korea

[73] Assignee: Goldstar Co., Ltd., Rep. of Korea

[21] Appl. No.: 758,144

[22] Filed: Sep. 12, 1991

[30] Foreign Application Priority Data

Sep. 14, 1990 [KR] Rep. of Korea ..... 90-14585

[51] Int. Cl.[5] ..... H01J 19/04

[52] U.S. Cl. ..... 313/270; 313/337; 313/446; 445/58; 445/36

[58] Field of Search ..... 313/270, 337, 446; 445/58, 36; 228/208, 209; 250/492.3

[56] References Cited

U.S. PATENT DOCUMENTS 3,908,183 9/1975 Ennis, Jr. ..... 250/492.3

4,184,100 1/1980 Takanashi et al. ..... 313/270

*Primary Examiner*—Donald J. Yusko

*Assistant Examiner*—N. D. Patel

*Attorney, Agent, or Firm*—Morgan & Finnegan

[57] ABSTRACT

A cathode structure for an electron tube that includes a cathode sleeve, an upper heat radiation part blackened by the oxidation of the Cr contained therein in order to increase the rate of the heat radiation, a lower supporting part covered by a nickel layer for preventing the oxidation of Cr, and a cathode sleeve holder that is connected to the lower supporting part by resistance welding.

6 Claims, 1 Drawing Sheet

CATHODE STRUCTURE FOR AN ELECTRON TUBE AND METHOD OF CONSTRUCTING IT

FIELD OF THE INVENTION

The present invention concerns a cathode structure for an electron tube, and more particularly the blackening of the cathode sleeve of the cathode structure.

BACKGROUND OF THE INVENTION

Conventionally, the cathode structure used in an electron tube of a TV, etc. comprises, as shown in FIG. 1, a cathode sleeve 1 cylindrically shaped to have an upper heat radiation part 1*a* and lower supporting part 1*b* having different diameters, the cathode sleeve being made of Ni-Cr alloy, a nickel sleeve cap 2 containing minute amount of reducing metal for closing the upper end of the upper heat radiation part 1*a*, an electron emissive substance 3 applied to the outer surface of the sleeve cap 2, a cathode sleeve holder 4 for holding the lower supporting part 1*b* of the cathode sleeve 1 and containing a heater 5 for heating the cathode.

In this cathode structure, the cathode sleeve 1 is blackened by oxidizing the Cr contained in the cathode sleeve in order to improve the heat radiation, thereby reducing the time during which the heater 5 is supplied with a voltage so as to cause a picture signal to appear on the screen of the electron tube. This time is hereinafter referred to as picture appearing time.

In other words, the picture appearing time is closely related to the rate of the heat radiation of the cathode sleeve 1, which rate is considerably increased by oxidizing the Cr contained in the cathode sleeve 1 in a wet hydrogen ambient at the temperature of 1100° C. The rate of the heat radiation of the blackened cathode sleeve 1 is about four times that of the unblackened cathode sleeve, and thus the picture appearing time is reduced to about a quarter of that in the case of the unblackened cathode sleeve.

However, it is conventionally hardly possible to attach the blackened cathode sleeve to the cathode sleeve holder 4 by resistance welding, and thus the blackening of the cathode sleeve inherently involves many difficulties. As a result, the blackening of the cathode sleeve is generally omitted, thus delaying the picture appearing time.

SUMMARY OF THE INVENTION

The object of the present invention is to provide a cathode structure for an electron tube that facilitates the attaching of the blackened cathode sleeve to the cathode sleeve holder by using resistance welding.

According to one aspect of the present invention, a cathode structure for an electron tube comprises a heater for heating an electron emissive substance to emit electrons, a cathode sleeve with an upper heat radiation part and lower supporting part for containing the heater, a sleeve cap for closing the upper end of the cathode sleeve, the electron emissive substance applied to the outer surface of the sleeve cap, and a cathode sleeve holder for holding the cathode sleeve with the lower supporting part connected thereto by resistance welding, wherein the upper heat radiation part of the cathode sleeve is blackened in order to increase heat radiation, while the lower supporting part is covered by a substance for preventing the blackening, thus facilitating the connection between the lower supporting part and cathode sleeve holder.

According to another aspect of the present invention, a method of manufacturing a cathode structure for an electron tube, comprising the steps of forming a blackening preventive layer on the part of a cathode sleeve connected to a cathode sleeve holder by resistance welding, closing the upper end of the heat radiation part of said cathode sleeve with a sleeve cap, applying a thermal electron emissive substance to the outer surface of said sleeve cap, and connecting the lower supporting part of said cathode sleeve to said cathode holder by resistance welding.

The present invention will now be described with reference to the drawings attached only by way of example.

BRIEF DESCRIPTION OF THE ATTACHED DRAWINGS

DETAILED DESCRIPTION OF CERTAIN PREFERRED EMBODIMENTS OF THE PRESENT INVENTION

Figure 1:
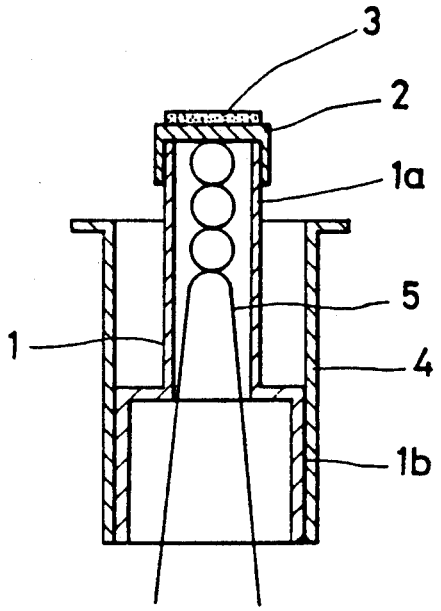
FIG. 1 PRIOR ART
FIG. 1 is a longitudinal cross sectional view of a conventional cathode structure for an electron tube.
Figure 2:
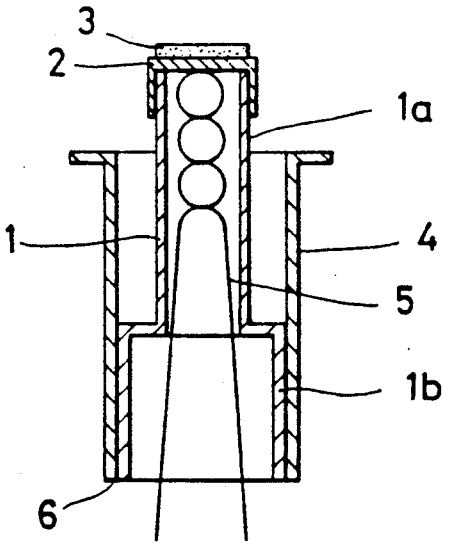
FIG. 2 is a longitudinal cross sectional view of an embodiment of the cathode structure for an electron tube according to the present invention.

Referring to FIG. 2, there is shown a cathode structure for an electron tube. A stepped cathode sleeve 1 made of Ni-Cr alloy comprises an upper heat radiation part 1*a* and lower supporting part 1*b*. The lower supporting part is attached to a cathode sleeve holder 4. A nickel sleeve cap 2 containing minute amount of reducing material closes the upper end of the upper heat radiation part 1*a* of the cathode sleeve 1. An electron emissive substance is applied to the outer surface of the sleeve cap 2. The lower supporting part 1*b* of the cathode sleeve 1 is inserted into the inside of the cathode sleeve holder 4. The cathode sleeve 1 receives a heater for heating an electron emissive substance to emit electrons. In this case, the outer surface of the lower supporting part 1*b* of the cathode sleeve 1 is covered by a nickel layer 6 for preventing the oxidation of the Cr contained therein, not so as to be blackened. The nickel layer 6 is obtained by nickeling the lower supporting part 1*b* of the cathode sleeve 1 in nickelic acid electrolytic solution comprising nickel sulfide or nickel chloride.

The method of constructing the inventive cathode structure comprises the steps of forming the nickel layer 6 of a given thickness by nickeling the outer surface of the lower supporting part 1*b* of the cathode sleeve 1 in the nickelic acid electrolytic solution comprising nickel sulfide or nickel chloride, attaching the sleeve cap 2 to the upper end of the upper heat radiation part 1*a* of the cathode sleeve 1, and blackening the cathode sleeve 1 in a wet hydrogen ambient at a high temperature. Thus, the upper heat radiation part 1*a* is blackened due to the oxidation of Cr, while the lower supporting part 1*b* is not blackened due to the nickel layer 6 that prevents the oxidation of Cr.

Then, the electron emissive substance 3 is deposited on the upper surface of the sleeve cap 2, and thereafter the lower supporting part 1*b* of the cathode sleeve 1 is fixedly attached to the cathode sleeve holder 4 by resistance welding.

As stated above, since the lower supporting part 1*b* of the cathode sleeve 1 is not blackened because of the nickel layer 6, it is facilitated to attach the lower supporting part 1*b* to the cathode sleeve holder 4 by resistance welding. Accordingly the inventive cathode structure enjoys that the rate of the heat radiation of the cathode sleeve 1 is increased to about four times that of the conventional one, and the picture appearing time is reduced to about a quarter of that of the conventional one.

Figure 3:
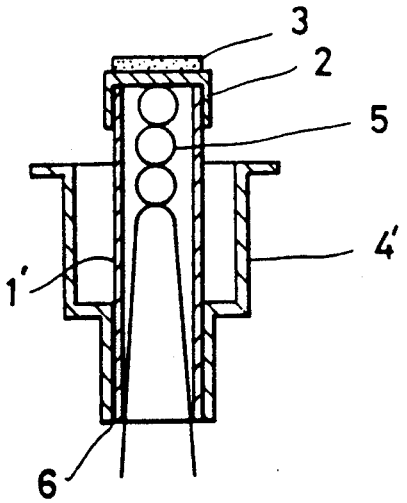
FIG. 3 is a longitudinal cross sectional view of another embodiment of the cathode structure for an electron tube according to the present invention.

Referring to FIG. 3, the cathode sleeve 1' is cylindrically shaped to have a uniform diameter along the whole length. In this case, the cathode sleeve holder 4' comprises two parts having different diameters. Of course, the outer surface of the part of the cathode sleeve 1' connected to the cathode sleeve holder 4' is covered by the nickel layer 6, and therefore the cathode sleeve 1' having the upper blackened part is fixedly connected to the cathode sleeve holder 4' by resistance welding.

Although the invention has been described in conjunction with specific embodiments, it is evident that many alternative and variations will be apparent to those skilled in the art in light of the foregoing description. Accordingly, the invention is intended to embrace all of the alternatives and variations that fall within the spirit and scope of the appended claims.

What is claimed is:

1. A cathode structure for an electron tube comprising:

(a) a heater for heating an electron emissive substance to emit electrons;

(b) a cathode sleeve with an upper heat radiation part and lower supporting part for containing said heater;

(c) a sleeve cap for closing the upper end of said cathode sleeve, said electron emissive substance applied to the outer surface of said sleeve cap; and (d) a cathode sleeve holder for holding said cathode sleeve with the lower supporting part connected thereto by resistance welding, wherein the upper heat radiation part of said cathode sleeve is blackened in order to increase heat radiation, while said lower supporting part is covered by a substance for preventing the blackening, thus facilitating the connection between said lower supporting part and cathode sleeve holder.

2. A cathode structure as claimed in claim 1, wherein substance for preventing the blackening being nickel.

3. A cathode structure as claimed in claim 1, wherein said sleeve is cylindrically shaped with the upper heat radiation part and lower supporting part having different diameters.

4. A cathode structure as claimed in claim 1, wherein said cathode sleeve is cylindrically shaped with the upper heat radiation part and lower supporting part having the same diameter.

5. A method of manufacturing a cathode structure for an electron tube, comprising the steps of:

(a) forming a blackening preventive layer on a lower supporting part of a cathode sleeve that is to be connected to a cathode sleeve holder by resistance welding;

(b) closing an upper end of a heat radiation part of said cathode sleeve with a sleeve cap;

(c) applying a thermal electron emissive substance to an outer surface of said sleeve cap;

(d) connecting the lower supporting part of said cathode sleeve to a cathode holder by resistance welding; and (e) blackening the heat radiation part of said cathode sleeve.

6. A method of manufacturing a cathode structure according to claim 5, wherein said blackening preventive layer of step (a) is formed by nickeling the lower supporting part of said cathode sleeve in a nickelic acid electrolytic solution comprising nickel sulfide or nickel chloride.

* * * * *